US010379485B2

(12) United States Patent
Kawanago

(10) Patent No.: US 10,379,485 B2
(45) Date of Patent: Aug. 13, 2019

(54) IMAGE FORMING APPARATUS WITH SEPARATELY HOUSED CLEANING BLADE AND CLEANING ROLLER

(71) Applicant: Konica Minolta, Inc., Tokyo (JP)

(72) Inventor: Takashi Kawanago, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/925,158

(22) Filed: Mar. 19, 2018

(65) Prior Publication Data

US 2018/0275597 A1 Sep. 27, 2018

(30) Foreign Application Priority Data

Mar. 22, 2017 (JP) ..... 2017-055283

(51) Int. Cl.
*G03G 21/00* (2006.01)
*G03G 15/16* (2006.01)

(52) U.S. Cl.
CPC ..... *G03G 21/0029* (2013.01); *G03G 15/161* (2013.01); *G03G 21/0058* (2013.01); *G03G 2215/1661* (2013.01)

(58) Field of Classification Search
CPC ..... G03G 21/0058
See application file for complete search history.

(56) References Cited

U.S. PATENT DOCUMENTS 5,450,184 A * 9/1995 Yanai ..... G03G 21/0017 15/256.5
2016/0026146 A1* 1/2016 Takai ..... G03G 15/161 399/350
2018/0113402 A1* 4/2018 Seko ..... G03G 15/161

FOREIGN PATENT DOCUMENTS

JP 2012155253 A 8/2012

* cited by examiner

*Primary Examiner* — Victor Verbitsky
(74) *Attorney, Agent, or Firm* — Lucas & Mercanti, LLP

(57) ABSTRACT

An image forming apparatus which transfers, onto paper, a toner image formed on a belt-shaped image carrier including an elastic layer on a surface thereof, and forms an image includes a rigid blade which cleans the surface of the image carrier in contact with the image carrier which has transferred the toner image onto the paper; a roller which is upstream of the rigid blade in a rotation direction of the image carrier, and cleans the surface of the image carrier upstream of the rigid blade by coming in contact with the image carrier which has transferred the toner image onto the paper; a rigid blade holder which holds the rigid blade; and a roller holder which holds the roller. The rigid blade holder and the roller holder are installed with a gap therebetween.

11 Claims, 5 Drawing Sheets

*FIG.5*

| THE NUMBER OF PAGES OF SERVICE LIFE | SEPARATE TYPE | INTEGRAL TYPE | WITHOUT PRE-BRUSH |
|---|---|---|---|
| 10000 | ○ | ○ | ○ |
| 50000 | ○ | ○ | ○ |
| 100000 | ○ | × | ○ |
| 200000 | ○ | × | × |
| 300000 | ○ | × | × |
| 400000 | ○ | × | × |
| 500000 | ○ | × | × |
| 600000 | ○ | × | × |

IMAGE FORMING APPARATUS WITH SEPARATELY HOUSED CLEANING BLADE AND CLEANING ROLLER

BACKGROUND

1. Technological Field

The present invention relates to an image forming apparatus.

2. Description of the Related Art

The image forming apparatus is now widespread which forms a toner image on a photoconductor, transfers the toner image onto an intermediate transfer belt (image carrier), and transfers the toner image on the intermediate transfer belt onto paper.

A configuration called a blade cleaning method is known in which a blade which scrapes the toner remaining on the intermediate transfer belt after the transfer onto paper. The blade is in contact with the intermediate transfer belt and is provided downstream of a position where the toner is transferred onto paper, in the rotation direction of the intermediate transfer belt in the image forming apparatus. The blade removes the remaining toner (refer to, for example, JP 2012-155253 A).

Moreover, in recent years, a configuration has been proposed which adopts an intermediate transfer belt including an elastic layer made of, for example, a rubber material on a base layer made of a resin material, to prevent a reduction in transfer performance, and uses a blade formed of a metal thin piece (a rigid blade) to reduce a belt drive torque.

In the blade cleaning method using such a rigid blade, the use of a roller upstream of the rigid blade, with respect to the rotation direction of the intermediate transfer belt, is being studied to ensure the cleaning performance and durability of the rigid blade. The roller is installed in such a manner as to counter-rotate with respect to the intermediate transfer belt. The roller has a function of removing paper dust on the intermediate transfer belt, before the paper dust reaches the rigid blade.

However, if such a roller is provided, there may be a case in which a housing of a holder of the rigid blade is deformed by the drive torque of the roller and the posture of the rigid blade is changed. Accordingly it becomes impossible to maintain uniformity of the edge angle of the blade.

The edge angle of the rigid blade is an important factor for maintaining the cleaning function. When the edge angle cannot be uniformly maintained, it is difficult to ensure cleaning performance over a long period of time.

SUMMARY

An issue of the present invention is to provide an image forming apparatus which can maintain cleaning performance over a long period of time.

To achieve at least one of the abovementioned objects, according to an aspect of the present invention, there is provided an image forming apparatus which transfers, onto paper, a toner image formed on a belt-shaped image carrier including an elastic layer on a surface thereof, and forms an image, the image forming apparatus including:

a rigid blade which cleans the surface of the image carrier in contact with the image carrier which has transferred the toner image onto the paper;

a roller which is upstream of the rigid blade in a rotation direction of the image carrier, and cleans the surface of the image carrier upstream of the rigid blade by coming in contact with the image carrier which has transferred the toner image onto the paper;

a rigid blade holder which holds the rigid blade; and a roller holder which holds the roller, wherein the rigid blade holder and the roller holder are installed with a gap therebetween.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein:

FIG. 5 is a diagram for explaining an effect of the belt cleaner; and

DETAILED DESCRIPTION OF EMBODIMENTS

Hereinafter, one or more embodiments of the present invention will be described with reference to the drawings. However, the scope of the invention is not limited to the disclosed embodiments.

Firstly, the configuration of an image forming apparatus in the embodiment is described.

Figure 1:
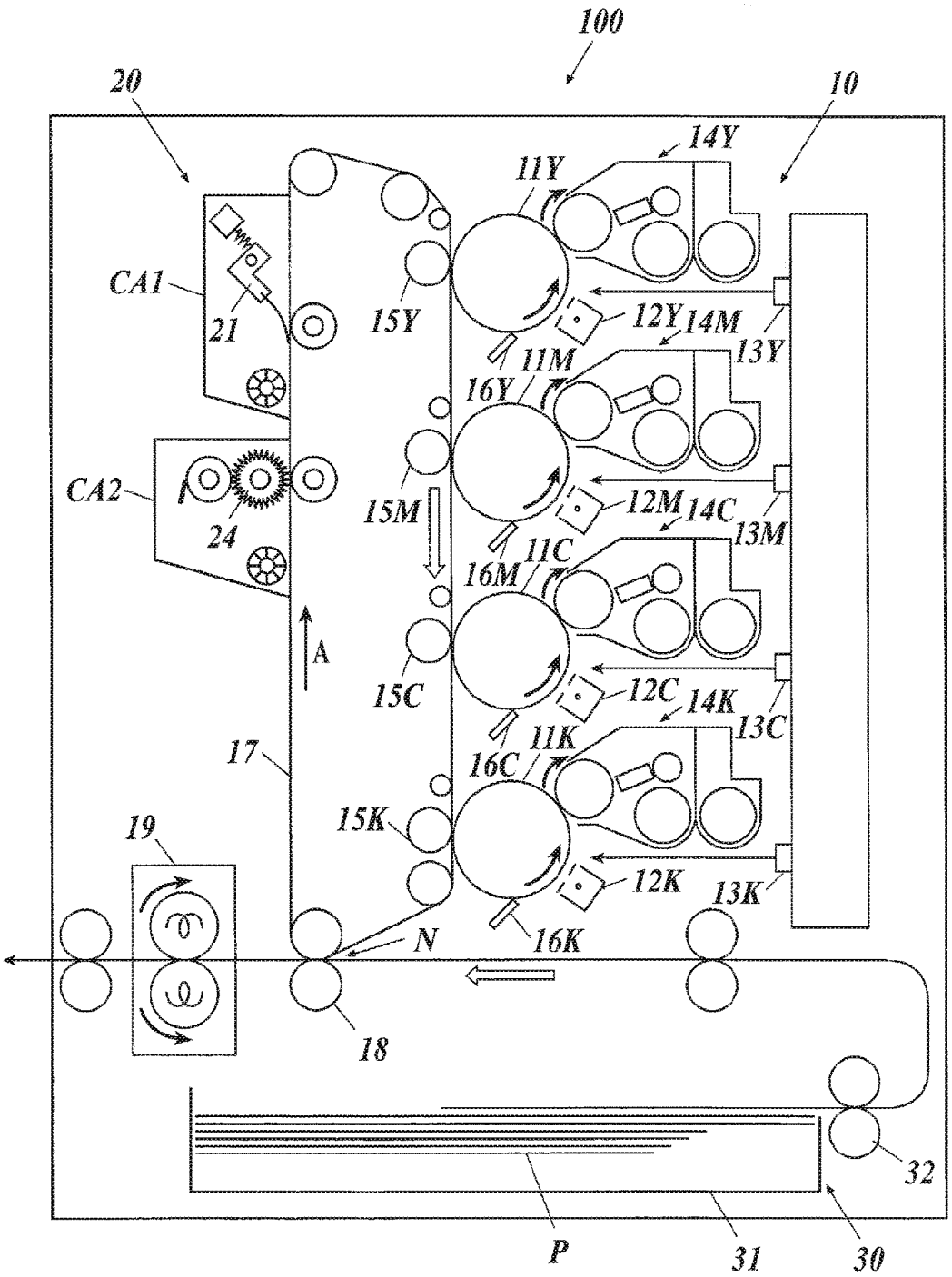
FIG. 1 is a schematic configuration diagram of an image forming apparatus in an embodiment of the present invention.
Figure 2:
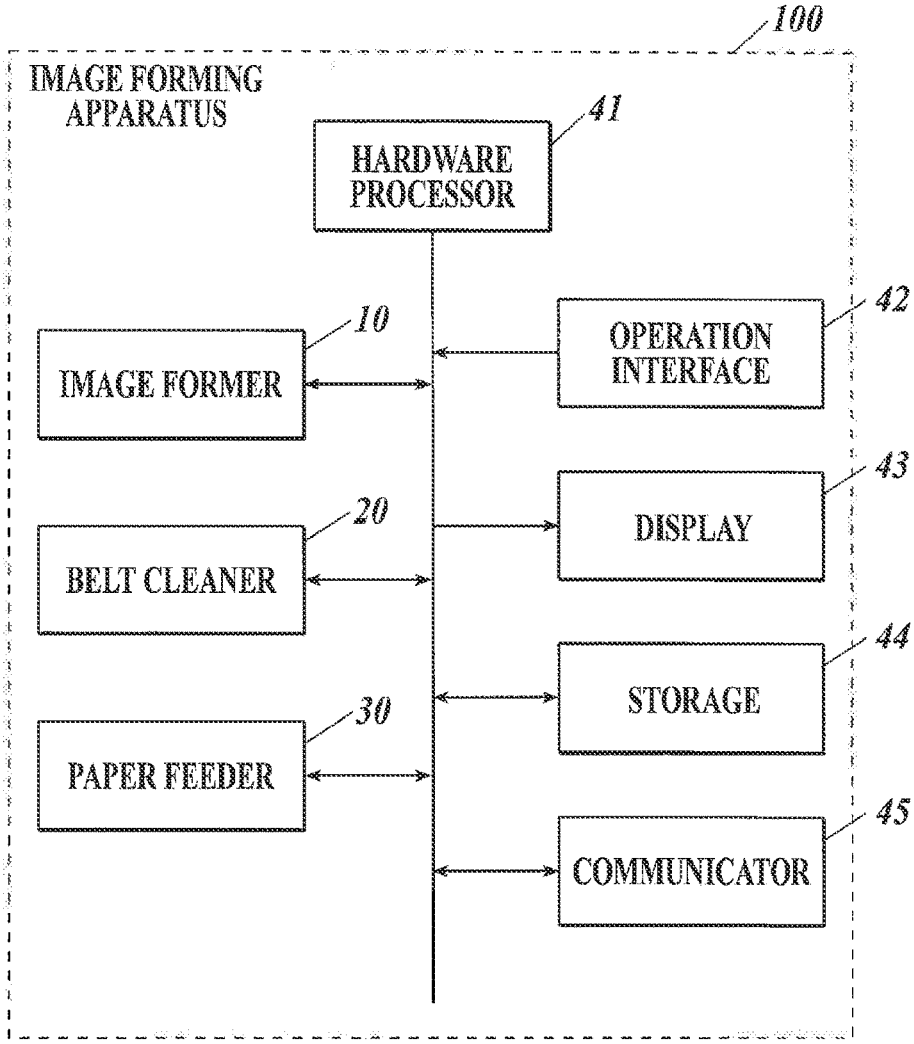
FIG. 2 is a function block diagram illustrating the control configuration of the image forming apparatus.

FIG. 1 is a schematic configuration diagram of an image forming apparatus 100. FIG. 2 is a block diagram illustrating the functional configuration of the image forming apparatus 100.

As illustrated in FIGS. 1 and 2, the image forming apparatus 100 is configured to include an image former 10, a belt cleaner 20, a paper feeder 30, a hardware processor 41, an operation interface 42, a display 43, a storage 44, and a communicator 45, which are connected to each other via a bus.

The image former 10 includes photosensitive drums 11Y, 11M, 11C, and 11K, chargers 12Y, 12M, 12C, and 12K, exposers 13Y, 13M, 13C, and 13K, developers 14Y, 14M, 14C, and 14K, primary transfer rollers 15Y, 15M, 15C, and 15K, photoconductor cleaner 16Y, 16M, 16C, and 16K, which correspond respectively to colors of yellow (Y), magenta (M), cyan (C), and black (K), an intermediate transfer belt 17 as an image carrier, a secondary transfer roller 18, and a fixer 19.

The chargers 12Y, 12M, 12C, and 12K charge the photosensitive drums 11Y, 11M, 11C, and 11K uniformly.

The exposers 13Y, 13M, 13C, and 13K are each configured to include a laser light source, a polygon mirror, and a lens, and scan and expose surfaces of the photosensitive drums 11Y, 11M, 11C, and 11K with laser beams on the basis of image data of the colors, and form latent images.

The developers 14Y, 14M, 14C, and 14K apply their respective color toners to the latent images on the photosensitive drums 11Y, 11M, 11C, and 11K to develop the images.

The primary transfer rollers 15Y, 15M, 15C, and 15K sequentially transfer the toner images of the colors formed on the photosensitive drums 11Y, 11M, 11C, and 11K onto the intermediate transfer belt 17 (primary transfer). In other words, a color toner image being the four-color superimposed toner images is formed on the intermediate transfer belt 17.

The photoconductor cleaners 16Y, 16M, 16C, and 16K remove the toner remaining on the peripheral surfaces of the photosensitive drums 11Y, 11M, 11C, and 11K after the transfer.

The intermediate transfer belt 17 is an endless belt including an elastic layer, is laid across a plurality of rollers (a drive roller, a tension roller, and a driven roller), and is driven to rotate in a direction indicated by an arrow A of FIG. 1. The details of the configuration of the intermediate transfer belt 17 are described below.

The secondary transfer roller 18 collectively transfers the color toner image formed on the intermediate transfer belt 17 onto one side of paper (a transferred body) P as the transferred body supplied from the paper feeder 30 (secondary transfer).

The fixer 19 fixes the toner transferred onto the paper P on the paper P by heating and pressing.

The belt cleaner 20 removes residues such as the remaining toner which was not transferred onto the paper P and remains, and paper dust from the intermediate transfer belt 17 after the color toner image was transferred by the secondary transfer roller 18 onto the paper P to clean the intermediate transfer belt 17. The details of the configuration of the belt cleaner 20 are described below.

The paper feeder 30 is provided to a lower part of the image forming apparatus 100, and includes a detachable paper feed cassette 31. It is configured in such a manner that the paper P stored in the paper feed cassette 31 is fed into a feed path by a paper feed roller 32, one by one from the top sheet.

The hardware processor 41 is configured to include a CPU (Central Processing Unit), a ROM (Read Only Memory), and a RAM (Random Access Memory), and integrally controls the processing operation of components of the image forming apparatus 100. The CPU reads various processing programs stored in the ROM, develops them in the RAM, and executes various processes in accordance with the developed programs.

The operation interface 42 includes a touchscreen formed in such a manner as to cover over a display screen of the display 43, and various operating buttons such as numeric buttons and a start button. The operation interface 42 outputs an operation signal based on the operation of a user to the hardware processor 41.

The display 43 is configured to include an LCD (Liquid Crystal Display), and displays various screens in accordance with instructions of display signals input from the hardware processor 41.

The storage 44 includes storage devices such as a non-volatile semiconductor memory and a hard disk, and stores, for example, data related to various processes.

The communicator 45 transmits and receives data to and from an external device connected to a network such as a LAN (Local Area Network).

[Configuration of Intermediate Transfer Belt]

Next, the configuration of the intermediate transfer belt 17 is described.

Figure 3:
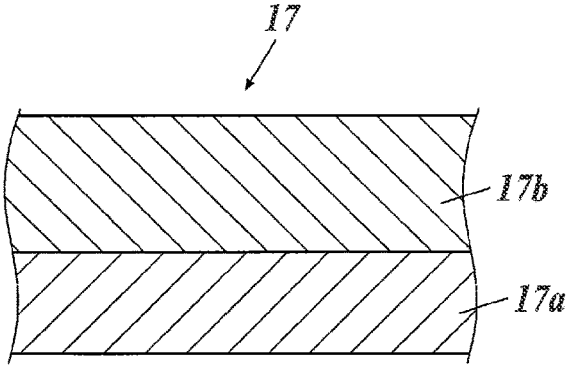
FIG. 3 is a cross-sectional view of an intermediate transfer belt.

FIG. 3 is a cross-sectional view of the intermediate transfer belt 17. In FIG. 3, the upper side is the outer peripheral side of the intermediate transfer belt 17.

As illustrated in FIG. 3, for example, an elastic belt where an elastic layer 17*b* made of rubber such as acrylnitril-butadien copolymer rubber (NBR) or chloroprene rubber (CR) is formed on a base layer 17*a* can be used for the intermediate transfer belt 17.

At this point in time, it is preferable to set the thickness of the base layer 17*a* to approximately 50 to 100 μm to make the transportability of the intermediate transfer belt 17 excellent, and set the thickness of the elastic layer 17*b* to approximately 100 to 500 μm to increase transfer performance for the uneven paper P.

Moreover, it is also preferable to provide an oxidation layer of approximately 3 to 20 μm, or a coat layer of approximately 3 to 50 μm, on a surface of the elastic layer 17*b* to reduce tackiness.

The intermediate transfer belt 17 is simply required to have desired transfer performance, and its material and thickness are not limited to those described above.

Moreover, the intermediate transfer belt 17 preferably has a surface microhardness of equal to or greater than 50 to 500 MPa. Here, the surface microhardness is evaluated using a microhardness tester (Fischerscope_H100) under conditions of an indenter at 90° (Cube Corner Top) and a maximum load of 30 μN.

If the surface microhardness of the intermediate transfer belt 17 is less than 50 MPa, that is, if the elastic layer 17*b* is too soft, the following situation may occur: infinitesimal deformation occurs on the surface of the elastic layer 17*b*, a reaction force acts in a direction of slipping through from the edge of the rigid blade 21*a*, the remaining toner slips by, and cleaning failure occurs.

On the other hand, if the surface microhardness of the intermediate transfer belt 17 exceeds 500 MPa, that is, if the elastic layer 17*b* is too hard, infinitesimal deformation does not occur on the surface of the elastic layer 17*b*. Accordingly, the following situation may occur: the surface of the elastic layer 17*b* cannot follow uneven contact at the ridge of the rigid blade 21*a*, minute gaps are generated, the remaining toner slips therethrough, and cleaning failure occurs.

[Configuration of Belt Cleaner]

Next, the configuration of the belt cleaner 20 is described.

Figure 4:
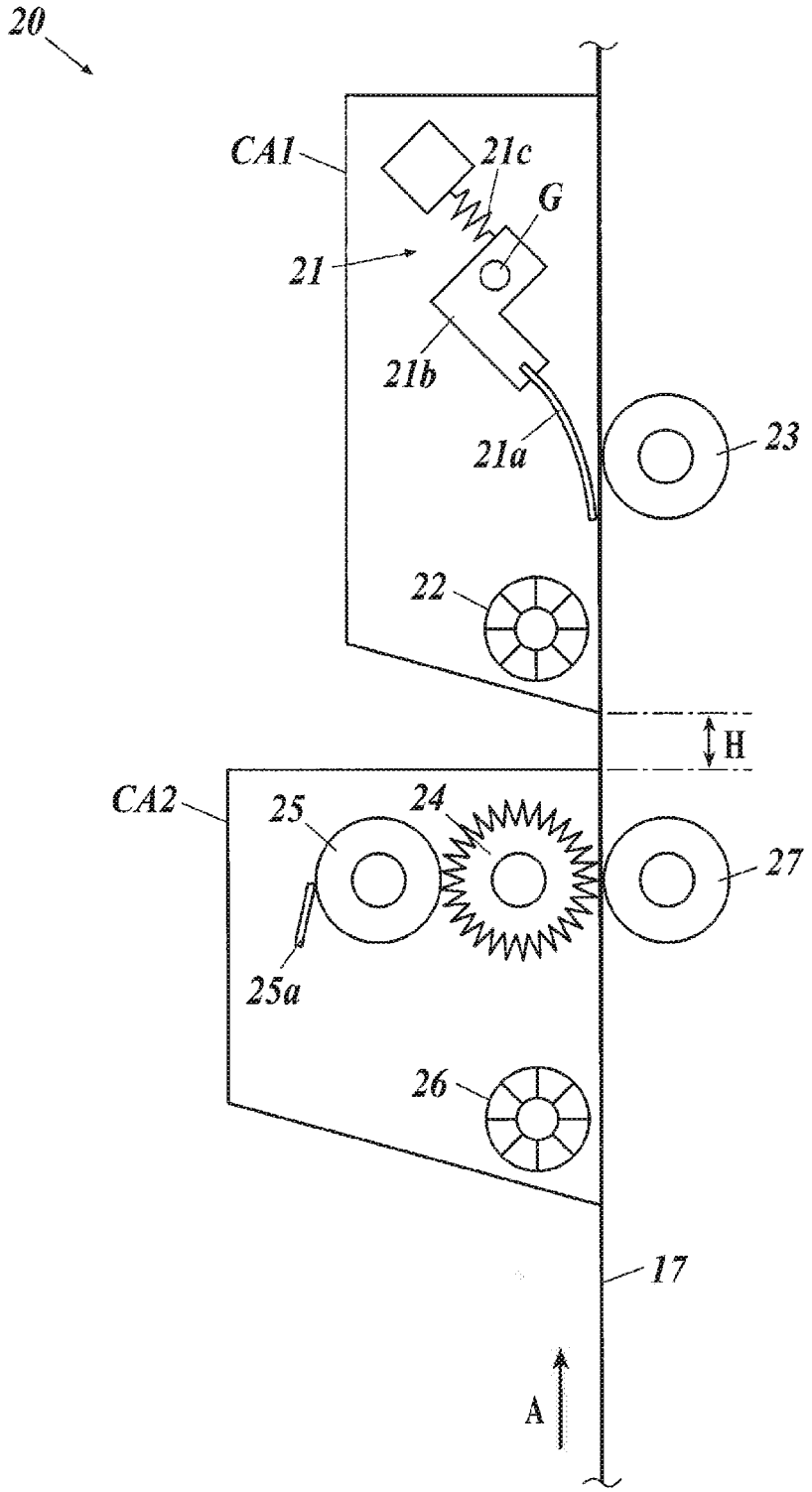
FIG. 4 is a diagram illustrating the configuration of a belt cleaner.

FIG. 4 is a schematic configuration diagram of the belt cleaner 20.

The components configuring the belt cleaner 20 is extra-long along a width direction intersecting the rotation direction of the intermediate transfer belt 17.

As illustrated in FIG. 4, the belt cleaner 20 includes a first casing CA1 as a rigid blade holder, and a second casing CA2 as a roller holder provided upstream of the first casing CA1 in the rotation direction of the intermediate transfer belt 17.

A gap H is provided between the first casing CA1 and the second casing CA2. The first casing CA1 and the second casing CA2 are placed in such a manner as to be in a non-contact state where they are not in contact with each other.

The first casing CA1 includes, for example, a blade section 21 and a screw 22 therein. In other words, the first casing CA1 is a housing which covers around the blade section 21 and the screw 22.

Moreover, a blade counter roller 23 as a first counter roller is provided at a position facing the first casing CA1 (the blade section 21) across the intermediate transfer belt 17.

The second casing CA2 includes, for example, a pre-brush 24 as a roller, a flicker roller 25, and a screw 26 therein. In other words, the second casing CA2 is a housing which covers around the pre-brush 24, the flicker roller 25, and the screw 26.

Moreover, a brush counter roller 27 as a second counter roller is provided at a position facing the second casing CA2 (the pre-brush 24) across the intermediate transfer belt 17.

The blade section 21 includes, for example, a rigid blade 21*a*, a blade holder 21*b*, and a biasing spring 21*c*.

The rigid blade 21*a* scrapes and removes residues on the intermediate transfer belt 17 with a distal end of the rigid blade 21*a* in counter contact with the rotating intermediate transfer belt 17. The rigid blade 21*a* is held by the blade holder 21*b* in such a manner as to be rotatable about a hinged support G.

It is preferable that the thickness of the rigid blade 21*a* be 70 to 200 μm. If the thickness of the rigid blade 21*a* exceeds 200 μm, the rigid blade 21*a* is too thick to follow unevenness in a longitudinal direction. If the thickness is less than 70 μm, the rigid blade 21*a* is too thin, and the edge floats, and the residue removal effect is reduced.

Moreover, it is also preferable that the rigid blade 21*a* include a coat layer of diamond-like carbon. At this point in time, the thickness of the coat layer is preferable to be 1 to 10 μm. If the thickness of the coat layer exceeds 10 μm, the coat layer is too thick relative to the dimension of the rigid blade 21*a*. Accordingly, the edge floats. If the thickness is less than 1 μm, it is too thin, and there is no point in the coat layer.

The blade holder 21*b* is configured in such a manner as to hold the rigid blade 21*a* at one end, and be rotatable about the hinged support G. The biasing spring 21*c* is engaged at the other end of the blade holder 21*b*. It is configured in such a manner that a contact force (contact pressure) of the rigid blade 21*a* against the intermediate transfer belt 17 is obtained by the force of the spring.

The biasing spring 21*c* is, for example, a tension coil spring. The biasing spring 21*c* applies the force of rotating in a counterclockwise direction to the blade holder 21*b* and the rigid blade 21*a* to bring the rigid blade 21*a* into contact with the intermediate transfer belt 17 with constant pressure.

In such a constant pressure contact method (spring loaded method), the contact pressure can be appropriately maintained irrespective of an environment. As long as the constant pressure contact method can be achieved, other than the tension coil spring, a helical compression spring or the like may also be used.

The screw 22 discharges the residue scraped by the rigid blade 21*a* to the outside of the first casing CAL The blade counter roller 23 is placed at the position facing the blade section 21 across the intermediate transfer belt 17.

The blade counter roller 23 is preferable to be placed, slightly displaced approximately 1 mm downstream of a distal end portion of the rigid blade 21*a* in the rotation direction of the intermediate transfer belt 17.

Such a placement can prevent the rigid blade 21*a* from being raised by minute projections and depressions on the blade counter roller 23, or minute projections and depressions on the intermediate transfer belt 17, and slipping by on the left and right of the minute uneven portion, what is called a stapler-like slip.

The pre-brush 24 is a brush body which rotates in a counter direction to the rotation direction of the intermediate transfer belt 17. The pre-brush 24 removes deposits, such as paper dust, on the intermediate transfer belt 17, the deposits reaching the rigid blade 21*a*, and reduces paper dust filming with the rigid blade 21*a*.

A torque of, for example, 0.1 to 0.4 N·m is applied between the pre brush 24 and the intermediate transfer belt 17. If the value of torque is less than 0.1 N·m, the cleaning function of the pre-brush 24 is not achieved. If the value of torque exceeds 0.4 N·m, the torque may be too large for the intermediate transfer belt 17 to rotate, and images may be displaced.

As long as a predetermined deposit removal function is provided, the material, physical properties, and settings of the pre-brush 24 are not particularly limited.

Moreover, it may not be a brush body such as the pre-brush 24, and may be, for example, a metal roller which has a suction effect by an electric field, or a foam roller.

The flicker roller 25 is provided at a position which can be in contact with the pre-brush 24, and rotates in a counter direction to the rotation direction of the pre-brush 24 to remove deposits attached to the pre-brush 24.

As long as a predetermined flicking function is provided, the material, physical properties, and settings of the flicker roller 25 are not particularly limited.

Moreover, a scraper 25*a* is provided to the flicker roller 25 to scrape deposits off the flicker roller 25.

The screw 26 discharges the deposits removed by the pre-brush 24 to the outside of the second casing CA2.

The brush counter roller 27 is placed at a position facing the pre-brush 24 across the intermediate transfer belt 17, and maintains the deposit removal function of the pre-brush 24 excellently.

Next, the operation of the belt cleaner 20 in the embodiment is described.

In the belt cleaner 20 of the embodiment, the pre-brush 24 counter-rotates with respect to the intermediate transfer belt 17 first, removes deposits such as paper dust on the intermediate transfer belt 17, and reduces deposits reaching the rigid blade 21*a*.

Next, the rigid blade 21*a* of the blade section 21 scrapes and removes the remaining residues which have not been transferred onto the paper P from the intermediate transfer belt 17 to clean the intermediate transfer belt 17.

In this manner, the pre-brush 24 is provided upstream of the blade section 21 to ensure the cleaning performance and durability of the rigid blade 21*a*.

Here, the rigid blade 21*a* is not capable of following the deformation of the intermediate transfer belt 17 unlike a rubber blade. Accordingly, even with a minute change in contact angle, the distal end of the rigid blade 21*a* may float slightly. The floating of the distal end causes the degradation of the cleaning performance (the slipping through of toner). Accordingly, the edge angle of the rigid blade 21*a* is preferable to be maintained uniformly from the beginning to the end of use.

However, if the blade section 21 and the pre-brush 24 are in the same housing, the housing may deform due to the drive torque of the pre-brush 24, and the posture (edge angle) of the rigid blade 21*a* may change.

In contrast, in the belt cleaner 20 of the embodiment, each of the blade section 21 and the pre-brush 24 has the separate housings, which are fixed separately. The rigid blade 21*a* can maintain the edge angle uniformly without being influenced by the drive torque of the pre-brush 24.

Moreover, each of the blade section 21 and the pre-brush 24 have the separate housings. Accordingly, it is possible to make the utmost use of their individual functions (lifespans).

FIG. 5 is a table comparing the numbers of pages where an image could be formed by the time image defect occurred in a case where the belt cleaner 20 of the embodiment illustrated in FIG. 4 was used, a case where the blade section 21 and the pre-brush 24 were in the same housing (an integral type), and a case where the pre-brush was not provided.

As illustrated in FIG. 5, the occurrence of image defect was not seen even beyond 600000 pages in the belt cleaner 20 of the embodiment while the occurrence of image defect was seen at 100000 pages in the case of the integral type. Moreover, the occurrence of image defect was seen at 200000 pages in the case where the pre-brush was not provided.

As described above, according to the embodiment, the image forming apparatus 100 which transfers, onto the paper P, a toner image formed on the intermediate transfer belt 17 including the elastic layer 17*b* at the surface thereof to form an image includes the metal rigid blade 21*a* which cleans the surface of the intermediate transfer belt 17 in contact with the intermediate transfer belt 17 which has transferred the toner image onto the paper P, the pre-brush 24 which is provided upstream of the rigid blade 21*a* in the rotation direction of the intermediate transfer belt 17 to clean the surface of the intermediate transfer belt 17 in contact with the intermediate transfer belt 17 upstream of the rigid blade 21*a*, the first casing CA1 which holds the rigid blade 21*a*, and the second casing CA2 which holds the pre-brush 24. The first casing CA1 and the second casing CA2 are installed with the gap H therebetween.

Hence, each of the rigid blades 21*a* and the pre-brush 24 have the separate housings. Accordingly, it is possible to prevent the drive torque of the pre-brush 24 from influencing the rigid blade 21*a*. Accordingly, it is possible to prevent the occurrence of a situation where the first casing CA1 which holds the rigid blade 21*a* is deformed due to the influence of the drive torque of the pre-brush 24, the posture of the rigid blade 21*a* is changed, and accordingly the edge angle cannot be uniformly maintained.

Hence, the cleaning performance can be ensured over a long period of time.

Moreover, in the embodiment, the flicker roller 25 is included which is in contact with the pre-brush 24 while counter-rotating, and scrapes deposits attached to the pre-brush 24.

Hence, it is possible to remove the deposits attached to the pre-brush 24 and promote an increase in the lifespan of the pre-brush 24.

Moreover, in the embodiment, the pre-brush 24 counter-rotates with respect to the intermediate transfer belt 17. A torque of equal to or greater than 0.1 N·m and equal to or less than 0.4 N·m is applied between the pre-brush 24 and the intermediate transfer belt 17.

Hence, the cleaning function of the pre-brush 24 can be appropriately maintained.

Moreover, in the embodiment, the blade counter roller 23 provided at the position facing the first casing CA1 across the intermediate transfer belt 17, and the brush counter roller 27 provided at the position facing the second casing CA2 across the intermediate transfer belt 17 are included. The edge of the rigid blade 21*a* is in contact with the intermediate transfer belt 17 at the position between the blade counter roller 23 and the brush counter roller 27.

Hence, it is possible to prevent the occurrence of slipping through due to the lifting of the rigid blade 21*a*.

Moreover, in the embodiment, the rigid blade 21*a* is in contact with the intermediate transfer belt 17 with constant pressure.

Hence, the contact pressure can be appropriately maintained irrespective of an environment.

Moreover, in the embodiment, the rigid blade 21*a* has a thickness of equal to or greater than 70 μm and equal to or less than 200 μm.

Hence, the bending of the rigid blade 21*a* can be appropriately maintained.

Moreover, in the embodiment, the rigid blade includes the coat layer of diamond-like carbon. The coat layer has a thickness of equal to or greater than 1 μm and equal to or less than 10 μm.

Hence, the wear of the rigid blade 21*a* can be prevented.

An embodiment to which the present invention can be applied is not limited to the above-mentioned embodiment, and can be modified as appropriate within the scope which does not depart from the gist of the present invention.

For example, the above embodiment has been described assuming that each of the first casing CA1 and the second casing CA2 has a shape which covers the components therein. However, as long as it has a configuration in which the drive torque of the pre-brush 24 does not influence the rigid blade 21*a*, the embodiment is not limited to the above configuration.

Figure 6:
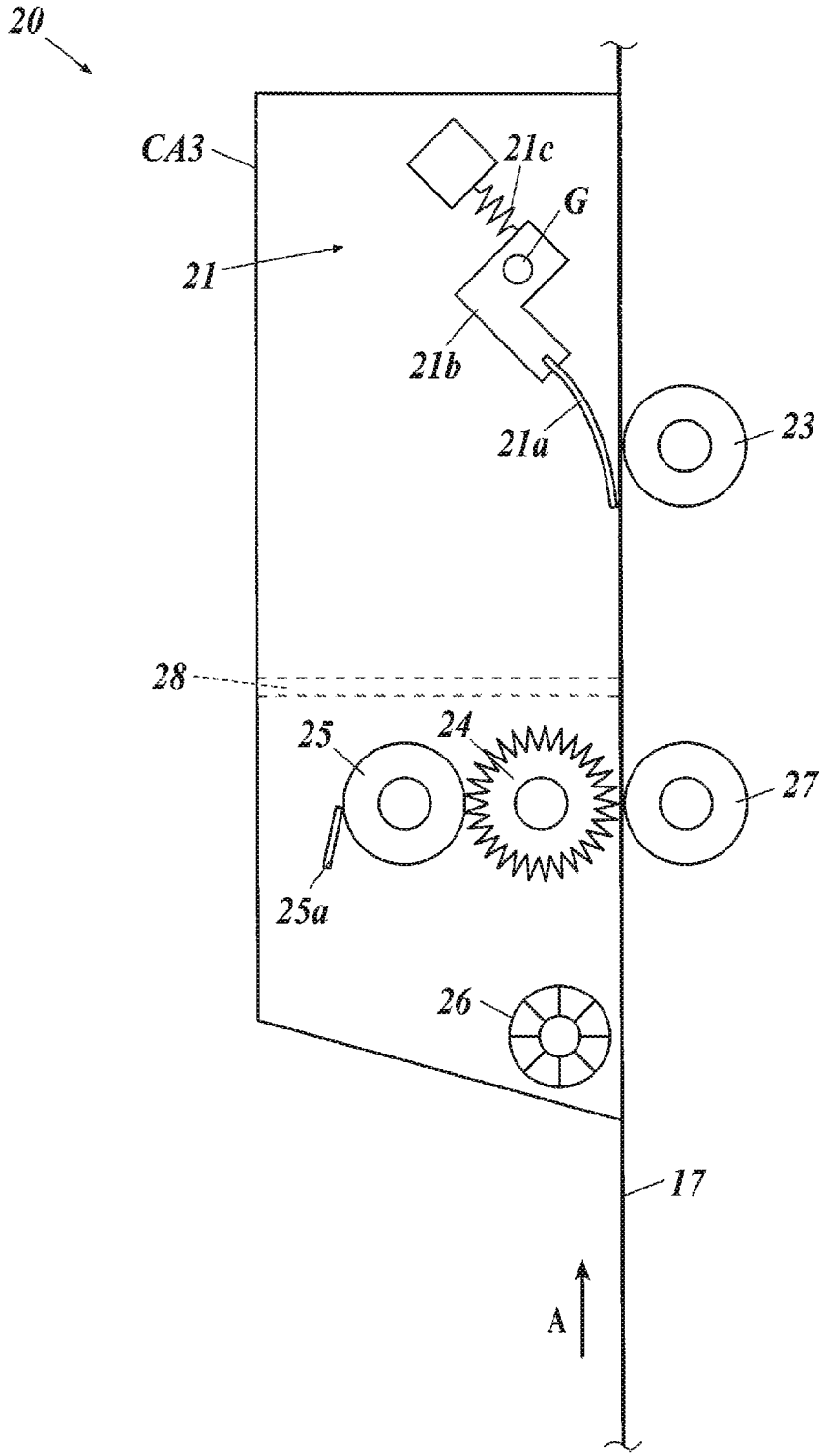
FIG. 6 is a diagram illustrating a modification of the belt cleaner.

For example, as illustrated in FIG. 6, a cut corresponding to the gap H may be provided at a position between the rigid blade 21*a* and the pre-brush 24 of one casing CA3. A soft member 28 which fills the cut (the gap H) may be provided.

In other words, the upper side of the casing CA3 is a housing whose underside is open. The lower side of the casing CA3 is a housing whose top side is open. The gap H is provided with the soft member 28 which fills the gap H.

For example, sponge, PET, or urethane can be used as the soft member 28.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2017-055283, filed on Mar. 22, 2017, is incorporated herein by reference in its entirety.

What is claimed is:

1. An image forming apparatus which transfers, onto paper, a toner image formed on a belt-shaped image carrier including an elastic layer on a surface thereof, the image forming apparatus comprising:

a rigid blade which cleans the surface of the image carrier in contact with the image carrier which has transferred the toner image onto the paper;

a roller which is upstream of the rigid blade in a rotation direction of the image carrier, and cleans the surface of the image carrier upstream of the rigid blade by coming in contact with the image carrier which has transferred the toner image onto the paper;

a first casing that houses a rigid blade holder which holds the rigid blade and houses a biasing spring connected to the rigid blade holder to force the rigid blade against the image carrier; and a second casing that houses the roller, wherein the first casing and the second casing are installed with a gap therebetween, the first casing has an underside which is open, the first casing covering the rigid blade, the second casing has a top side which is open, the second casing covering the roller, and a soft member fills the gap.

2. The image forming apparatus according to claim 1, wherein the rigid blade is a metal blade.

3. The image forming apparatus according to claim 1, wherein the roller is a brush roller.

4. The image forming apparatus according to claim 1, comprising a flicker roller which is in contact with the roller while counter-rotating with respect to the roller, and scrapes deposits attached to the roller.

5. The image forming apparatus according to claim 1, wherein the roller counter-rotates with respect to the image carrier, and a torque of equal to or greater than 0.1 N·m and equal to or less than 0.4 N·m is applied between the roller and the image carrier.

6. The image forming apparatus according to claim 1, further comprising:

a first counter roller at a position facing the first casing across the image carrier; and a second counter roller at a position facing the second casing across the image carrier, wherein an edge of the rigid blade is in contact with the image carrier at a position between the first and second counter rollers.

7. The image forming apparatus according to claim 1, wherein the rigid blade is in contact with the image carrier with constant pressure.

8. The image forming apparatus according to claim 1, wherein the rigid blade has a thickness of equal to or greater than 70 μm and equal to or less than 200 μm.

9. The image forming apparatus according to claim 1, wherein the rigid blade includes a coat layer of diamond-like carbon.

10. The image forming apparatus according to claim 9, wherein the coat layer has a thickness of equal to or greater than 1 μm and equal to or less than 10 μm.

11. An image forming apparatus which transfers, onto paper, a toner image formed on a belt-shaped image carrier including an elastic layer on a surface thereof, the image forming apparatus comprising:

a rigid blade which cleans the surface of the image carrier in contact with the image carrier which has transferred the toner image onto the paper;

a roller which is upstream of the rigid blade in a rotation direction of the image carrier, and cleans the surface of the image carrier upstream of the rigid blade by coming in contact with the image carrier which has transferred the toner image onto the paper;

a first casing that houses a rigid blade holder which holds the rigid blade and houses a biasing spring connected to the rigid blade holder to force the rigid blade against the image carrier; and a second casing that houses the roller, wherein the first casing and the second casing are installed with a gap therebetween, the roller counter-rotates with respect to the image carrier, and a torque of equal to or greater than 0.1 N·m and equal to or less than 0.4 N·m is applied between the roller and the image carrier.

* * * * *